US011885331B2

(12) United States Patent
Heubner

(10) Patent No.: US 11,885,331 B2
(45) Date of Patent: Jan. 30, 2024

(54) PUMP UNIT FOR A DRIVE TRAIN OF A MOTOR VEHICLE

(71) Applicant: FTE AUTOMOTIVE GmbH, Ebern (DE)

(72) Inventor: Wilhelm Heubner, Ebern (DE)

(73) Assignee: FTE AUTOMOTIVE GmbH, Ebern (DE)

( * ) Notice: Subject to any disclaimer, the term of this patent is extended or adjusted under 35 U.S.C. 154(b) by 0 days.

(21) Appl. No.: 17/181,078

(22) Filed: Feb. 22, 2021

(65) Prior Publication Data

US 2021/0270267 A1 Sep. 2, 2021

(30) Foreign Application Priority Data

Feb. 27, 2020 (DE) ..... 10 2020 105 173.5

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 18/00*** | (2006.01) |
| ***F04C 2/344*** | (2006.01) |
| ***F04C 14/24*** | (2006.01) |
| ***F04C 15/06*** | (2006.01) |

(52) U.S. Cl.

CPC ..... *F04C 2/3446* (2013.01); *F04C 2/344* (2013.01); *F04C 14/24* (2013.01); *F04C 15/06* (2013.01); *F04C 15/066* (2013.01)

(58) Field of Classification Search

CPC ..... F04C 2/344; F04C 2/348; F04C 2/3441; F04C 2/3446; F04C 2/3447; F04C 11/001; F04C 11/003; F04C 14/24; F04C 15/008; F04C 15/06; F04C 15/064; F04C 15/066; F04C 240/40

See application file for complete search history.

(56) References Cited

U.S. PATENT DOCUMENTS

| | | | | |
|---|---|---|---|---|
| 2,993,445 | A * | 7/1961 | Ostwald | F04C 14/02 417/288 |
| 2009/0162230 | A1* | 6/2009 | Fujita | F04C 2/3446 418/259 |
| 2011/0173965 | A1 | 7/2011 | Holmes et al. | |
| 2012/0275945 | A1 | 11/2012 | Schulz-Andres et al. | |

(Continued)

FOREIGN PATENT DOCUMENTS

| | | |
|---|---|---|
| DE | 199 52 167 A1 | 6/2000 |
| DE | 100 27 813 A1 | 12/2001 |

(Continued)

OTHER PUBLICATIONS

WO-03056180-A1—AGNER et al.—Pump—Jul. 10, 2003—the English Translation (Year: 2003).*

(Continued)

*Primary Examiner* — Theresa Trieu

(74) *Attorney, Agent, or Firm* — Oblon, McClelland, Maier & Neustadt, L.L.P.

(57) ABSTRACT

A pump unit which has at least one high-pressure port and at least one low-pressure port, having a motor and a hydraulic pump which has at least one high-pressure outlet and at least one low-pressure outlet, wherein the high-pressure outlet is connected to the high-pressure port via at least one pressure-regulating valve.

5 Claims, 7 Drawing Sheets

(56) References Cited

U.S. PATENT DOCUMENTS

| | | | | |
|---|---|---|---|---|
| 2012/0312655 | A1 | 12/2012 | Heubner | |
| 2013/0243620 | A1 | 9/2013 | Lutoslawski et al. | |
| 2015/0068340 | A1 | 3/2015 | Wi et al. | |
| 2015/0075152 | A1 * | 3/2015 | Wi | F04C 2/3446 418/259 |
| 2017/0059032 | A1 | 3/2017 | Son et al. | |

FOREIGN PATENT DOCUMENTS

| | | | | |
|---|---|---|---|---|
| DE | 101 60 286 | A1 | 6/2003 | |
| DE | 10 2010 005 930 | A1 | 7/2011 | |
| DE | 10 2013 114 868 | A1 | 3/2015 | |
| EP | 2 532 914 | A1 | 12/2012 | |
| WO | WO-03056180 | A1 * | 7/2003 | F04C 11/001 |
| WO | WO 2012/045164 | A1 | 4/2012 | |

OTHER PUBLICATIONS

Extended European Search Report dated May 14, 2021 in European Patent Application No. 21157753.1, 8 pages.
German Search Report dated Jan. 21, 2021 in German Application 10 2020 105 173.5 filed Feb. 27, 2020 (with English Translation of Categories of Cited Documents and Written Opinion), 7 pages.

* cited by examiner

PUMP UNIT FOR A DRIVE TRAIN OF A MOTOR VEHICLE

BACKGROUND OF THE INVENTION

The invention relates to a pump unit which can be used in the drive train of a motor vehicle in order to supply at least one actuator (for example a clutch actuator) and a lubricant and/or coolant circuit with hydraulic fluid.

DESCRIPTION OF THE RELATED ART

In order to supply an actuator with hydraulic fluid, use is normally made of a high-pressure pump which can provide for example a pressure of 40 bar at a volumetric flow rate of 1 l/min.

In order to supply a lubricant and/or coolant circuit with hydraulic fluid (for example for the purpose of lubricating bearing points in a gearbox or of cooling friction clutches when these are switched with slippage), use is normally made of a low-pressure pump which can provide for example a pressure of 4 bar at a volumetric flow rate of 10 l/min.

WO 2012/045164 A1 has disclosed a rotary vane pump in which provision is made of two differently formed pump chambers in order to provide a high-pressure fluid flow and a low-pressure fluid flow using a stator and a rotor. However, even with such a pump, it is not possible to provide fluid flows having highly different characteristics.

Owing to the different requirements, use is therefore normally made of two separate pumps to provide a high-pressure fluid flow and a low-pressure fluid flow.

BRIEF SUMMARY OF THE INVENTION

It is an object of the invention to reduce the outlay in terms of construction that is necessary to provide, in particular for a drive train of a motor vehicle, a high-pressure fluid flow and a low-pressure fluid flow.

For the purpose of achieving said object, provision is made according to the invention of a pump unit which has at least one high-pressure port and at least one low-pressure port, having a motor and a hydraulic pump which has at least one high-pressure outlet and at least one low-pressure outlet, wherein the high-pressure outlet is connected to the high-pressure port via at least one pressure-regulating valve. The invention is based on the fundamental concept of integrating into a single pump unit a pump which can simultaneously provide two different hydraulic flows, specifically a hydraulic flow serving for lubrication and/or cooling that has low pressure but high volumetric flow rate, and a hydraulic flow serving for actuating an actuator that has high pressure but low volumetric flow rate. In this way, in comparison with solutions which require two separate pumps for the different requirements, the outlay for the hydraulic connections and also the costs and the structural volume are reduced.

According to one configuration of the invention, it is provided that a short-circuit valve is arranged upstream of the pressure-regulating valve. If the hydraulic pump is operated permanently in order to maintain a coolant/lubricant flow, the short-circuit valve makes it possible for the hydraulic fluid delivered via the high-pressure outlet to be conducted directly back into a storage vessel before it has to flow through the pressure-regulating valve. In this way, the flow resistance is reduced.

According to one configuration of the invention, it is provided that the hydraulic pump has two high-pressure outlets, each of which leads to a high-pressure port of the pump unit. This makes it possible for two actuators to be actuated separately, for example in order, in a dual clutch gearbox, to actuate two clutches such that the flow of force can be transmitted from one gear stage to another one without interruption of the traction force.

It may be provided that the hydraulic pump has two low-pressure outlets, which lead to a single low-pressure port of the pump unit. This results in a particularly large delivery volume.

It may also be provided that the hydraulic pump has two low-pressure outlets, one of which leads to a lubricant circuit low-pressure port of the pump unit and the other one of which leads to a switching valve, said switching valve having two outlets, one of which leads to a clutch-cooling low-pressure port of the pump unit and the other one of which leads to the lubricant circuit low-pressure port. In this configuration, it is possible, according to requirement, for a part of the low-pressure delivery volume to be branched off for the purpose of cooling one of more clutches, while when this is not necessary, said part of the delivery volume is fed to a lubricant circuit.

Preferably, provision is made of a storage vessel which is integrated into the pump unit and from which drawing-in by the hydraulic pump is realized. In this way, a particularly compact design is provided, and hoses to an external storage vessel are not necessary.

According to a preferred embodiment, the hydraulic pump has a low-pressure pump, into which a high-pressure pump is integrated. This results in a particularly compact design.

It is possible for provision to be made of a branch from the low-pressure outlet, which branch leads to the suction side of the high-pressure pump, with the result that the high-pressure pump is provided with the hydraulic fluid at a positive pressure, which improves the filling of the high-pressure pump chambers.

According to a preferred embodiment, the hydraulic pump is a rotary vane pump having multiple rotary vanes which, together with a stator and the rotor, delimits multiple low-pressure chambers, wherein each rotary vane delimits a high-pressure chamber within the rotor. In this embodiment, the rotary vanes, besides their normal function, specifically to externally delimit together with the stator the different pump chambers, have yet a further function; the rotary vanes act as pump pistons since, during the rotation of the rotor, they are adjusted in an (at least approximately) radial direction. The inner surface of the stator thus acts in a manner similar to a cam disc, against which the rotary vanes bear and whose peripherally changing spacing to the axis of rotation of the rotor is converted into a pump stroke of the rotary vanes. This makes it possible for the high-pressure pump to be integrated into the normal structural volume of a rotary vane pump.

According to one configuration, the stator has two side walls, wherein, in at least one of the side walls, provision is made of a high-pressure outlet, which is assigned to the high-pressure chamber. This makes it possible for the highly pressurized hydraulic fluid expelled by the rotary vanes by way of their "inner side" to be discharged in a technically very simple manner.

In at least one of the side walls, provision may be made of an inlet for hydraulic fluid, which inlet is assigned to both the low-pressure chamber and the high-pressure chamber. This results in low outlay in terms of construction.

Alternatively, it may be provided that, in at least one of the side walls, provision is made of a high-pressure inlet, which is assigned exclusively to the high-pressure chamber, wherein provision is made of a low-pressure inlet, which is separate from the high-pressure inlet and is assigned exclusively to the low-pressure chamber. Separate inlets for the high-pressure chamber and the low-pressure chamber allow the filling behaviour of the pump chambers to be improved. Moreover, it is possible for the high-pressure inlets to be provided with a supply by way of the branch from the low-pressure outlet of the hydraulic pump.

The rotary vane pump may be of single-flow or two-flow design, according to structural requirements.

BRIEF DESCRIPTION OF THE SEVERAL VIEWS OF THE DRAWINGS

The invention will be described below on the basis of various embodiments, which are illustrated in the appended drawings. In these drawings.

DETAILED DESCRIPTION OF THE INVENTION

Figure 1:
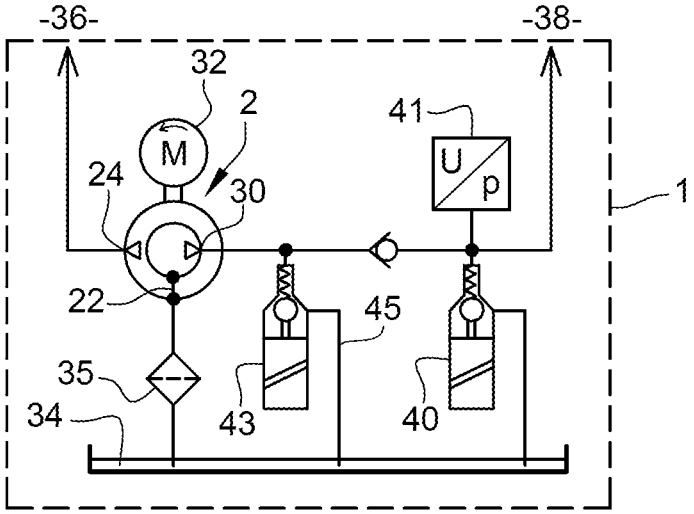
FIG. 1 schematically shows a pump unit according to a first embodiment of the invention.

FIG. 1 schematically shows a pump unit 1 which has a hydraulic pump 2 which is driven by a motor 32. This motor 32 is an electric motor.

The hydraulic pump 2 draws hydraulic fluid out of a storage vessel 34 by means of an inlet 22, which storage vessel is preferably integrated into the pump unit.

A filter 35 is arranged between the storage vessel 34 and the hydraulic pump 2.

The hydraulic pump 2 has a low-pressure outlet 24 and a high-pressure outlet 30.

The low-pressure outlet 24 is connected to a low-pressure port 36 of the pump unit 1. A lubricant circuit, for example, may be connected to the low-pressure port.

The high-pressure outlet 30 is assigned to a high-pressure port 38 of the pump unit. An actuator, for example a clutch actuator, may be connected to the high-pressure port 38.

In order to be able to actuate the clutch actuator in the desired manner, a pressure-regulating valve 40, which is assigned a pressure sensor 41, is arranged between the high-pressure outlet 30 of the hydraulic pump 2 and the high-pressure port of the pump unit 1.

Provision is furthermore made here of a short-circuit valve 43, by way of which, in the open state, the volume flow from the high-pressure outlet 30 can be conducted directly (via a line 45) back into the storage vessel. This results in a low flow resistance, which is advantageous if the hydraulic pump 2 is operated permanently in order, via the low-pressure port 36, to provide a supply for example to a lubricant circuit.

The valves 40, 43 are preferably solenoid valves, which are in particular open when electrically de-energized.

Figure 2:
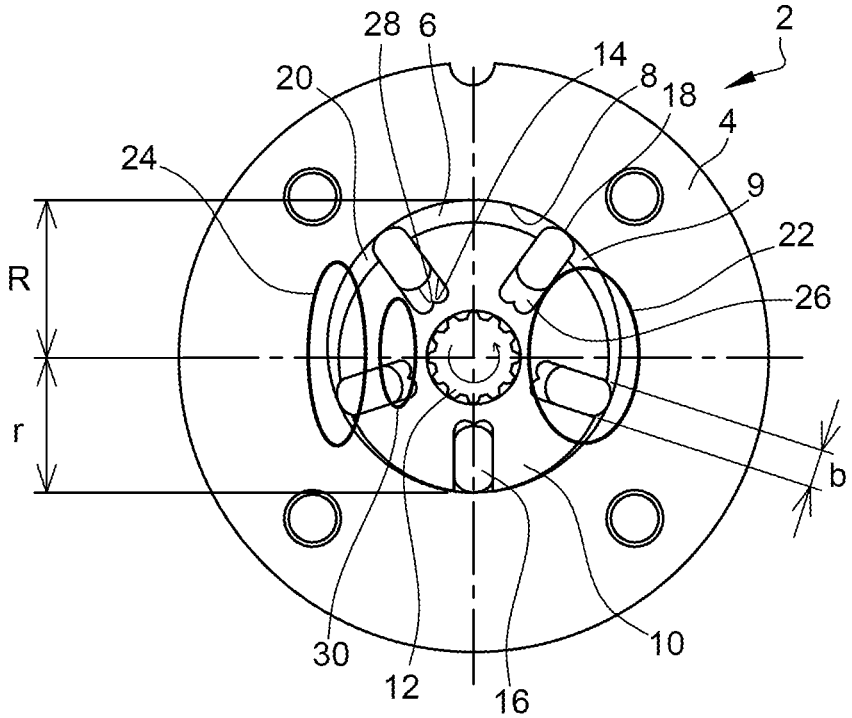
FIG. 2 shows, in a cross section, a hydraulic pump such as can be used in the pump unit according to the first embodiment.

FIG. 2 shows, in cross section, a hydraulic pump 2 which can be used in the pump unit in FIG. 1.

Here, the hydraulic pump 2 is a rotary vane pump. It has a stator 4 in which there is formed an interior space 6 which is surrounded by an inner wall 8.

A rotor 10 is arranged in the interior of the stator 4 and is mounted on a shaft 12 and can be driven by the latter. The rotor 10 of the rotary vane pump 2 is moved into rotation by the motor 32.

The rotor 10 is provided with multiple receptacles 14, in which in each case one rotary vane 16 is received.

The receptacles 14 extend in the axial direction normally from a face side of the rotor 10 as far as the opposite face side, and from the outer periphery of the rotor inwards. In the exemplary embodiment shown, the receptacles 14 extend in the radial direction. This is not necessary, however.

Here, the rotary vanes are in the form of plates whose dimension in the radial direction is slightly less than the radial depth of the receptacles 14. Each of the plates has a thickness b, which corresponds to the width of the receptacles 14.

As an alternative to plate-like rotary vanes, use may also be made of rotary vanes which are in the form of a cylinder.

The rotor 10 has a diameter of 2×r (minus a clearance between rotor and stator that is to be provided in the design), which is less than the diameter r+R of the interior space 6 of the stator 4. The rotor 10 is arranged eccentrically in the interior space, specifically such that it is (almost) in contact with the inner wall 8 on one side (at the 6 o'clock position in this case). Accordingly, the maximum spacing to the outer wall of the rotor 10 is on the diametrically opposite side.

The rotary vanes 16 bear with their radially outer side 18 permanently against the inner wall 8 of the stator 4 (at any rate when the rotor 10 is rotating). Consequently, between rotating vanes 16 adjacent to one another in the peripheral direction, the inner wall 8 of the stator 4, the outer wall of the rotor 10 and two side walls which close off the interior space 6 at the face sides of the rotor 10 (and of which only the "rear" side wall 9 can be seen here), in each case one low-pressure chamber 20 is delimited.

In the exemplary embodiment shown, there are, since five rotary vanes 16 are present, also formed five low-pressure chambers 20. The volume of each individual low-pressure chamber, for one rotation of the rotor 10 through 360°, changes from a minimum value (when the low-pressure chamber 20 is approximately at the 6 o'clock position) via a maximum value (when the low-pressure chamber 20 is approximately at the 12 o'clock position) and back to the minimum value.

Hydraulic fluid is fed to the low-pressure chambers 20 through the inlet 22. Said inlet, as seen in the direction of rotation of the rotor 10, is situated behind the point at which the spacing between the outer surface of the rotor 10 and the inner wall 8 of the stator 4 is minimal.

The hydraulic fluid drawn in by the low-pressure chambers 20 via the inlet 22 is delivered via a low-pressure outlet 24, which, as seen in the peripheral direction, is behind the position at which the low-pressure chambers 20 have the maximum volume, but in front of the position at which the spacing between the outer side of the rotor 10 and the inner wall 8 of the stator 4 is minimal.

The inlet 22 and the low-pressure outlet 24 are arranged here in one of the side walls 9 of the hydraulic pump 2 or else, so as to improve the filling, in both side walls 9, so that the hydraulic fluid can be drawn into the low-pressure chamber 20, and pushed out therefrom, from both sides.

Each of the rotary vanes 16 delimits together with the rotor 10 (and also the side walls 9) in each case one high-pressure chamber 26. Specifically, each radially inner side 28 of each rotary vane 16 delimits together with the walls of the receptacle 14 and the side walls 9 shown in each case one high-pressure chamber 26.

The volume of the high-pressure chambers 26 changes according to the displacement of the rotary vanes 16 in the receptacles 14. When the rotary vanes 16 move outwards (that is to say during a movement from the 6 o'clock position to the 12 o'clock position via the 3 o'clock position in the exemplary embodiment shown), the volume of the high-pressure chambers 26 increases, and when the rotary vanes 16 move inwards (that is to say during a movement from the 12 o'clock position to the 6 o'clock position via the 9 o'clock position), the volume decreases.

In this way, there is formed a piston pump in which the radially inner side 28 of each rotary vane 16 may be regarded as the face surface of a pump piston which is adjusted by means of a curved path (of the inner wall 8 of the stator 4). For drawing-in, the pump piston is adjusted outwards under the action of centrifugal force, and for pushing-out, the pump piston is displaced inwards owing to the contour of the inner wall 8 of the stator 4.

The high-pressure chamber 26 draws in via the same inlet 22 as that which provides a supply to the low-pressure chambers 20.

A high-pressure outlet 30 which is separate from the low-pressure outlet 24 is provided on the pressure side of the high-pressure pump. In the peripheral direction, said high-pressure outlet is arranged approximately at the same position as the low-pressure outlet 24.

The high-pressure outlet 30 may be provided either at only one of the side walls 9 of the stator 4 (and thus also of the rotor 10) or at both face sides.

Figure 3:
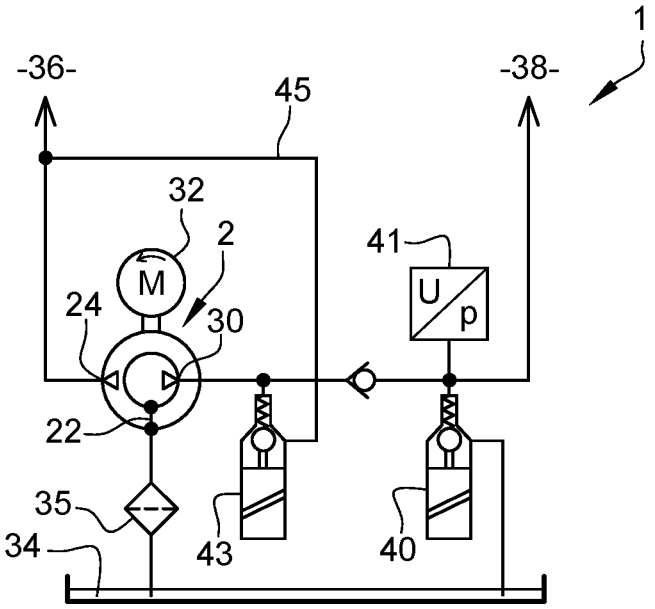
FIG. 3 schematically shows a pump unit according to an embodiment variant with respect to the first embodiment.

FIG. 3 shows an embodiment variant which is based on the first embodiment. The same reference signs are used for the components known from the first embodiment, and, to this extent, attention is drawn to the above explanations.

The difference with respect to the first embodiment is that, in the embodiment variant, the line 45 from the outlet of the short-circuit valve 43 leads not to the storage vessel 34 but to the low-pressure circuit, so as to increase the delivery flow to the low-pressure port 36 and thus to the lubrication arrangement.

Figure 4:
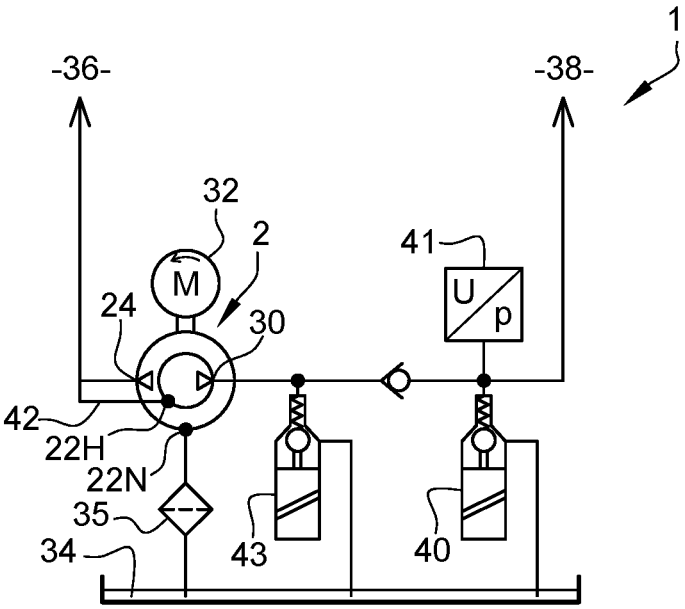
FIG. 4 schematically shows a pump unit according to a second embodiment of the invention.

FIG. 4 shows a pump unit 1 according to a second embodiment. The same reference signs are used for the components known from the preceding embodiment, and, to this extent, attention is drawn to the above explanations.

Figure 5:
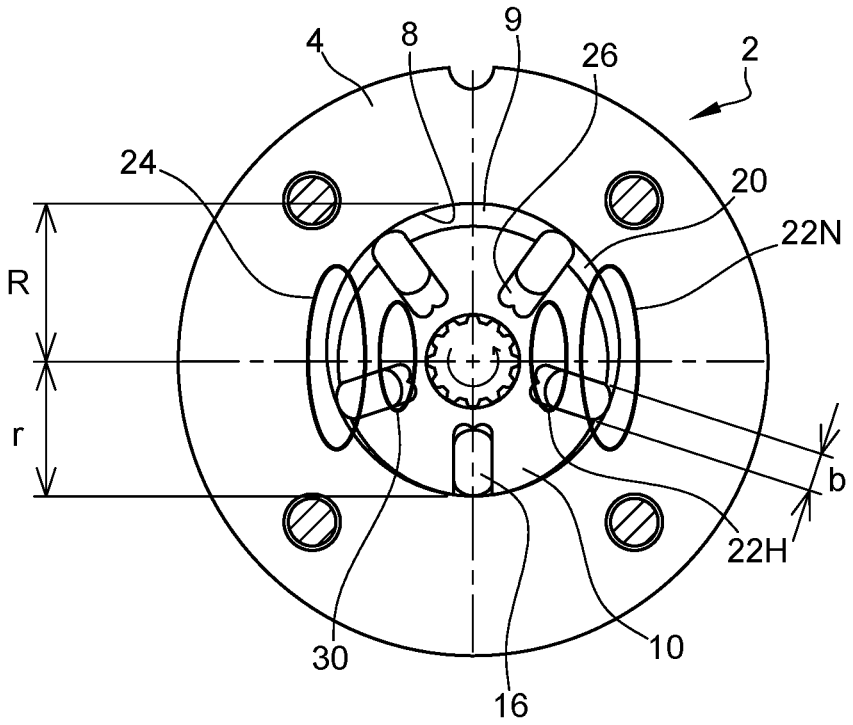
FIG. 5 shows, in a cross section, a hydraulic pump such as can be used in the pump unit according to the second embodiment.

FIG. 5 shows the hydraulic pump 2 used in the second embodiment. The same reference signs are used for the components already known from the hydraulic pump 2 shown in FIG. 2, and, to this extent, attention is drawn to the above explanations.

The difference between the hydraulic pump in FIG. 2 and the hydraulic pump in FIG. 5 is that, in the hydraulic pump in FIG. 5, two separate inlets, specifically a low-pressure inlet 22N and a high-pressure inlet 22H, are used on the suction side.

Accordingly, the difference between the pump unit 1 according to the first embodiment and the pump unit 1 according to the second embodiment is that, in the second embodiment, only the low-pressure inlet 22N is connected to the storage vessel 34. The high-pressure inlet 22H, by contrast, is provided with a supply via a branch 42 from the low-pressure outlet 24.

The advantage of this embodiment is that the hydraulic fluid is fed to the high-pressure inlet 22H at positive pressure, with the result that said hydraulic fluid can fill the high-pressure chamber 26 more effectively. Moreover, it is ensured that the rotary vanes 16 reliably bear against the inner wall 8 of the stator 4 even in the case of low rotational speeds of the rotary vane pump 2.

Figure 6:
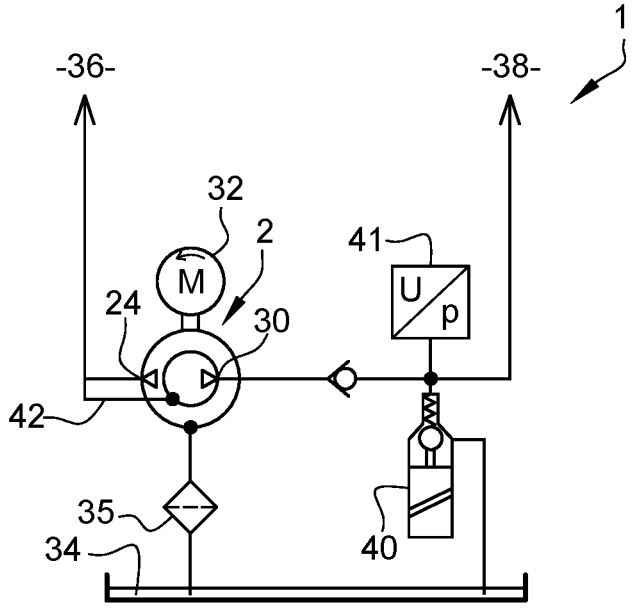
FIG. 6 schematically shows a pump unit according to a third embodiment.

FIG. 6 shows a pump unit 1 according to a third embodiment. The same reference signs are used for the components known from the preceding embodiments, and, to this extent, attention is drawn to the above explanations.

In the pump unit 1 according to the third embodiment, the same hydraulic pump 2 as in the second embodiment is used.

The difference with respect to the second embodiment is that, in the third embodiment, the short-circuit valve 43 is dispensed with. This pump unit 1 is particularly suitable for small hybrid drives of motor vehicles or for exclusively battery-operated vehicles, in which only a single clutch has to be switched. In the normal state, the pump unit 1 is off. Only when the clutch has to be actuated is the motor 32 switched on, so as to be able to actuate the clutch actuator. In this case, a coolant flow is then also provided.

Figure 7:
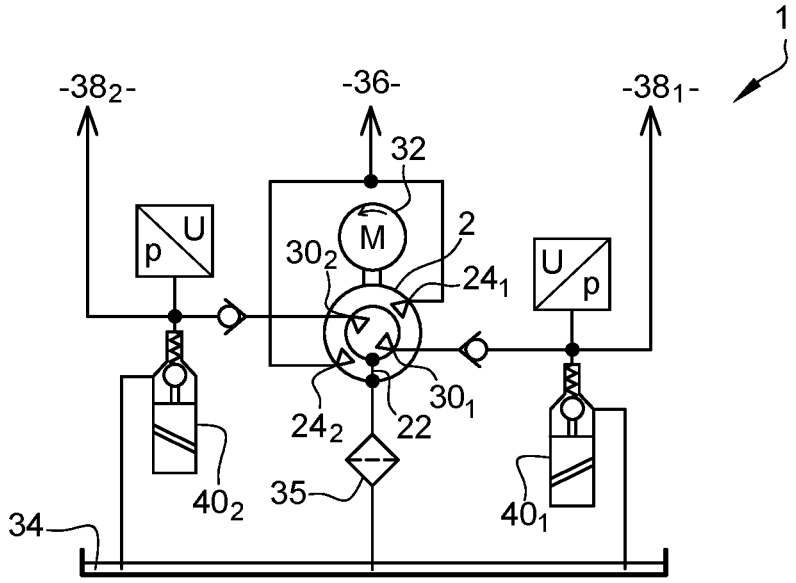
FIG. 7 schematically shows a pump unit according to a fourth embodiment of the invention.

FIG. 7 shows a pump unit 1 according to a fourth embodiment. The same reference signs are used for the components known from the preceding embodiments, and, to this extent, attention is drawn to the above explanations.

Figure 8:
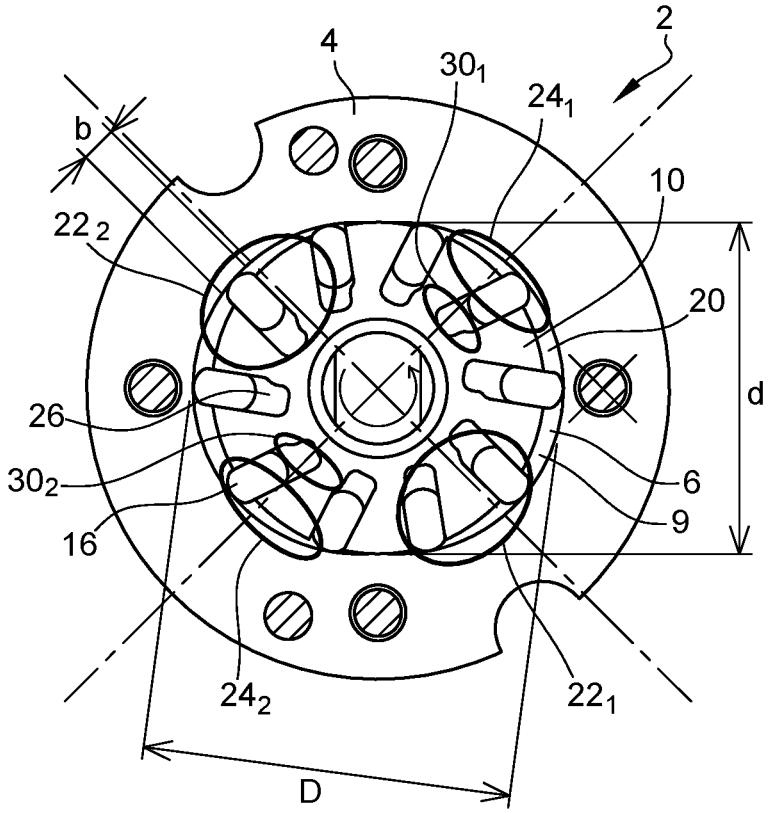
FIG. 8 shows, in a cross section, a hydraulic pump such as can be used in the pump unit according to the fourth embodiment.

FIG. 8 shows the hydraulic pump 2 used in the fourth embodiment. The same reference signs are used for the components already known from the hydraulic pumps in FIGS. 2 and 5, and, to this extent, attention is drawn to the above explanations.

The difference between the fourth embodiment and the preceding embodiments is that, in the fourth embodiment, two high-pressure ports $\mathbf{38}_1$, $\mathbf{38}_2$ are provided. By way of the latter, it is possible for example for two clutch actuators to be actuated in order, in a dual clutch gearbox, to switch the drive power from one gear stage to another without interruption of the traction force.

The hydraulic pump 2 used here is based in principle on the hydraulic pump 2 shown in FIG. 2, which has a common inlet 22 both for the low-pressure chambers 20 and for the high-pressure chambers 26 and two separate outlets, specifically a low-pressure outlet 24 and a high-pressure outlet 30.

The difference with respect to the hydraulic pump 2 known from FIGS. 2 and 5 is that the hydraulic pump in FIG. 8 has a double-stroke or two-flow structure. Here, the interior space 6, as seen in cross section, is slightly elongate with a longer diameter D, which is greater than the diameter d of the rotor 10, wherein said diameter d corresponds to the shorter diameter d of the interior space. Accordingly, each rotary vane 16 is displaced outwardly and inwardly twice during a rotation of the rotor 10 through 360°. Thus, with regard to the high-pressure pump, each "pump piston" (rotary vane 16) performs two pump strokes during a rotation of the rotor 10 through 360°.

Accordingly, two inlets $\mathbf{22}_1$, $\mathbf{22}_2$ are provided, and there are two low-pressure outlets $\mathbf{24}_1$, $\mathbf{24}_2$ and two high-pressure outlets $\mathbf{30}_1$, $\mathbf{30}_2$.

The two high-pressure outlets provide a supply to the high-pressure ports $\mathbf{38}_1$, $\mathbf{38}_2$, and the two low-pressure outlets $\mathbf{24}_1$, $\mathbf{24}_2$ jointly serve to provide a supply to the lower-pressure port 36. There may be connected thereto a coolant circuit by way of which it is possible to cool the two clutches, whose actuators are actuated via the high-pressure ports $\mathbf{38}_1$, $\mathbf{38}_2$. When a gear-shift process is required, the motor 32 is activated such that a high-pressure fluid for actuating the clutch actuators and a low-pressure fluid for cooling are provided. Outside these phases, the motor 32 is deactivated, and the pressure at the clutch can be held by way of the check valve and the closed proportional valve.

It may also be mentioned in passing that, in the embodiment in FIG. 7, the central plane of the receptacles 14 no longer extends through the axis of rotation of the rotor 10, but rather the plane of the rear side walls of the receptacles 14 as seen in the direction of rotation extends therethrough.

Figure 9:
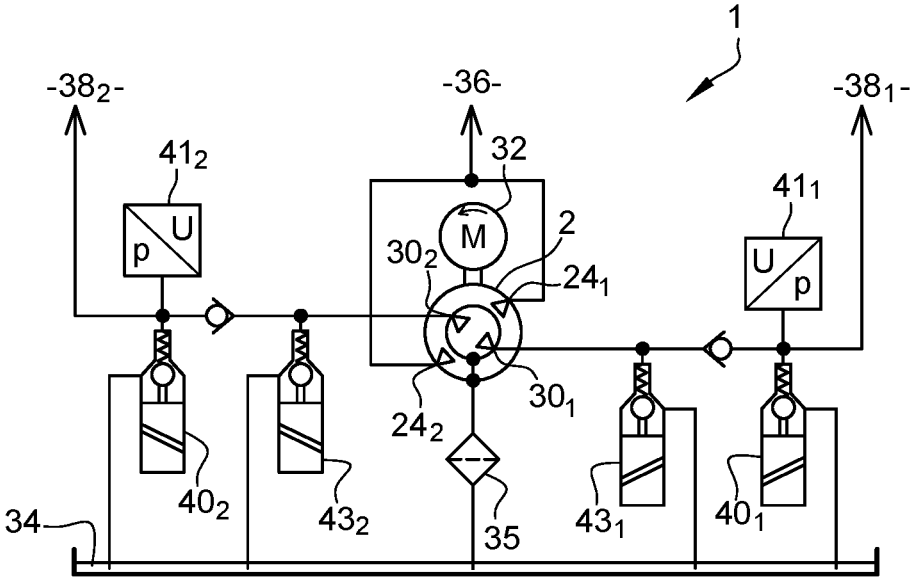
FIG. 9 schematically shows a pump unit according to a fifth embodiment of the invention.

FIG. 9 shows a fifth embodiment, which is based on the fourth embodiment. The same reference signs are used for the components known from the preceding embodiments, and, to this extent, attention is drawn to the above explanations.

The difference between the fifth embodiment and the fourth embodiment is that, in the embodiment shown in FIG. 9, the pump unit 1 is intended for continuous operation, albeit with variable rotational speed of the hydraulic pump 2. In this way, a continuous supply of lubricant or coolant via the low-pressure port 36 of the pump unit 1 is ensured.

In order to reduce the flow losses in the phases in which no actuators need to be actuated via the high-pressure ports $\mathbf{38}_1$, $\mathbf{38}_2$, a short-circuit valve $\mathbf{43}_1$, $\mathbf{43}_2$ is arranged upstream of each pressure-regulating valve $\mathbf{40}_1$, $\mathbf{40}_2$.

The short-circuit valves 43 are closed when the high-pressure ports 38 of the pump unit 1 have to be supplied with hydraulic fluid. If, by contrast, the corresponding pressure-regulating valve 40 is either fully open, in order to relieve the corresponding actuator of load, or fully closed, in order to keep the pressure in the actuator at a fixed value, the corresponding short-circuit valve 43 is opened so that the high-pressure fluid provided can be conducted with low resistance directly back into the storage vessel 34. This reduces the drive torque necessary for operating the hydraulic pump 2.

Figure 10:
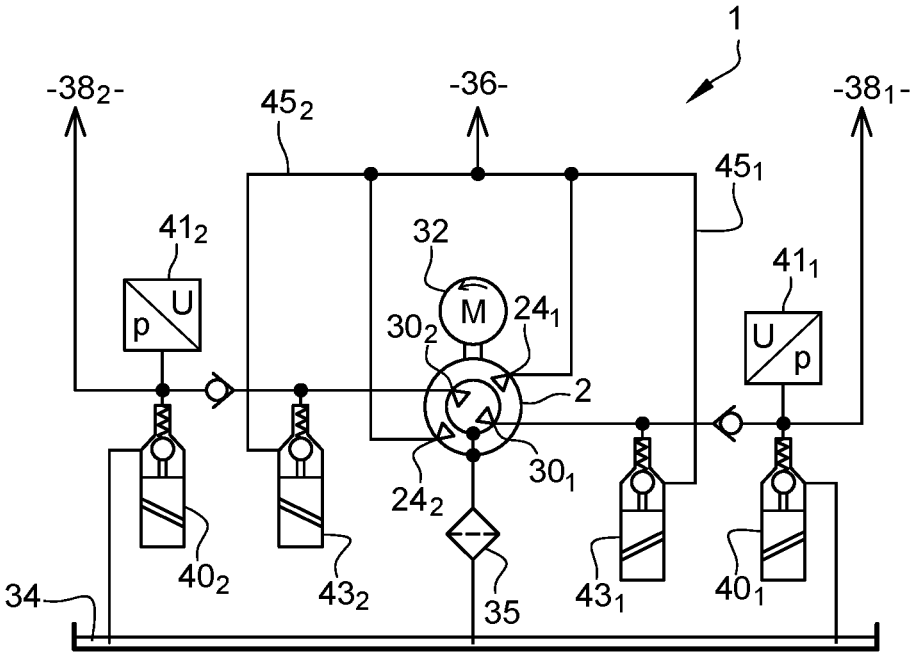
FIG. 10 schematically shows a pump unit according to an embodiment variant with respect to the fifth embodiment.

FIG. 10 shows an embodiment variant with respect to the fifth embodiment. The same reference signs are used for the components known from the preceding embodiments, and, to this extent, attention is drawn to the above explanations.

The difference between the fifth embodiment and the embodiment variant in FIG. 10 is that, in the embodiment variant, in the same manner as in the embodiment variant in FIG. 3, the lines $\mathbf{45}_1$, $\mathbf{45}_2$ from the outlet of the short-circuit valves $\mathbf{43}_1$, $\mathbf{43}_2$ lead not to the storage vessel 34 but to the low-pressure circuit, so as to increase the delivery flow to the low-pressure port 36 and thus to the lubrication arrangement.

Figure 11:
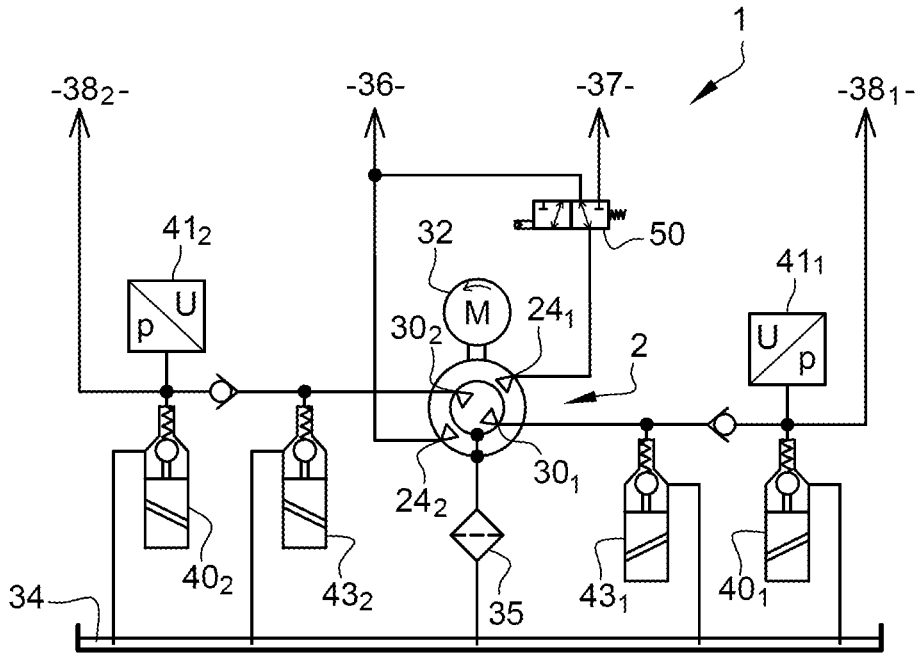
FIG. 11 schematically shows a pump unit according to a sixth embodiment of the invention.

FIG. 11 shows a sixth embodiment. The same reference signs are used for the components known from the preceding embodiments, and, to this extent, attention is drawn to the above explanations.

The difference between the sixth embodiment and the fifth embodiment is that, in the embodiment in FIG. 11, the pump unit 1 has two low-pressure ports 36, 37.

The low-pressure port 36 serves for providing a supply to a lubricant circuit and is connected to one of the low-pressure outlets of the hydraulic pump 2, specifically to the low-pressure outlet $\mathbf{24}_2$.

The other low-pressure outlet $\mathbf{24}_1$ leads to a switchover valve 50, which, in a manner dependent on its switching position, passes the provided hydraulic fluid to a clutch-cooling low-pressure port 37 or to the lubricant low-pressure port 36.

If it is required to cool the clutches actuated via the high-pressure ports 38, the switchover valve 50 is actuated such that the hydraulic flow from the low-pressure outlet $\mathbf{24}_1$ of the hydraulic pump 2 is conducted to the clutch-cooling low-pressure port 37.

If it is not required to cool the clutches, the switchover valve 50 returns to the position shown in FIG. 11, in which position the hydraulic flow from the low-pressure outlet $\mathbf{24}_1$ is merged with the hydraulic flow provided from the low-pressure outlet $\mathbf{24}_2$ and is conducted to the lubricant low-pressure port 36.

Figure 12:
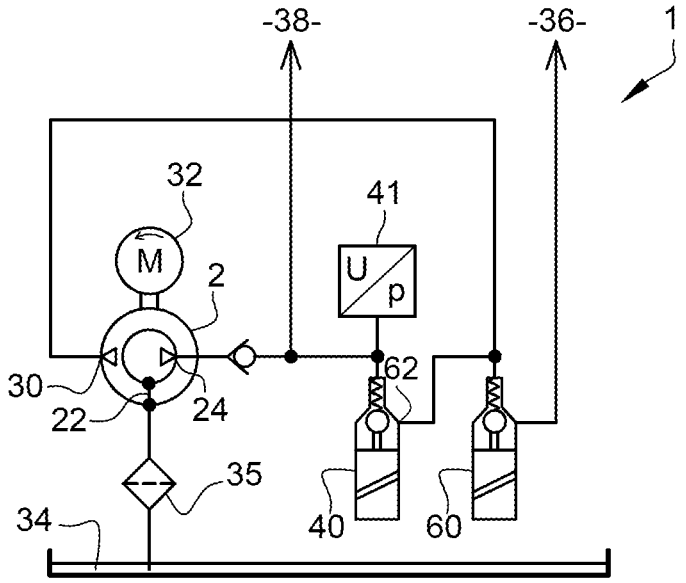
FIG. 12 schematically shows a pump unit according to a seventh embodiment of the invention.

FIG. 12 shows a seventh embodiment. The same reference signs are used for the components known from the preceding embodiments, and, to this extent, attention is drawn to the above explanations.

The seventh embodiment is based on the third embodiment. The difference with respect to the third embodiment is that, in the seventh embodiment, provision is made of an accumulation valve 60, which is arranged between the low-pressure outlet 24 of the hydraulic pump 2 and the low-pressure port 36. Here, the outlet 62 of the pressure-regulating valve 40 is connected upstream of the accumulation valve 60.

The accumulation valve 60 may be closed when an actuator connected to the high-pressure port 38, for example a clutch actuator, is to be pre-filled very quickly in order, in the case of a clutch actuator, to very quickly bring the clutch to the point at which it starts to transmit a torque ("kiss point"). With a closed accumulation valve 60 and open pressure-regulating valve 40, the latter is flowed through "backwards", specifically by the large volume flow from the low-pressure outlet 24 of the hydraulic pump 2. Consequently, the actuator can be filled much more quickly than by the volume flow from the high-pressure outlet 30.

As soon as the clutch actuator has been sufficiently pre-filled, the accumulation valve 60 is opened, while the pressure-regulating valve 40 is suitably closed and regulated in order to perform the actuation of the clutch actuator in the normal manner.

Figure 13:
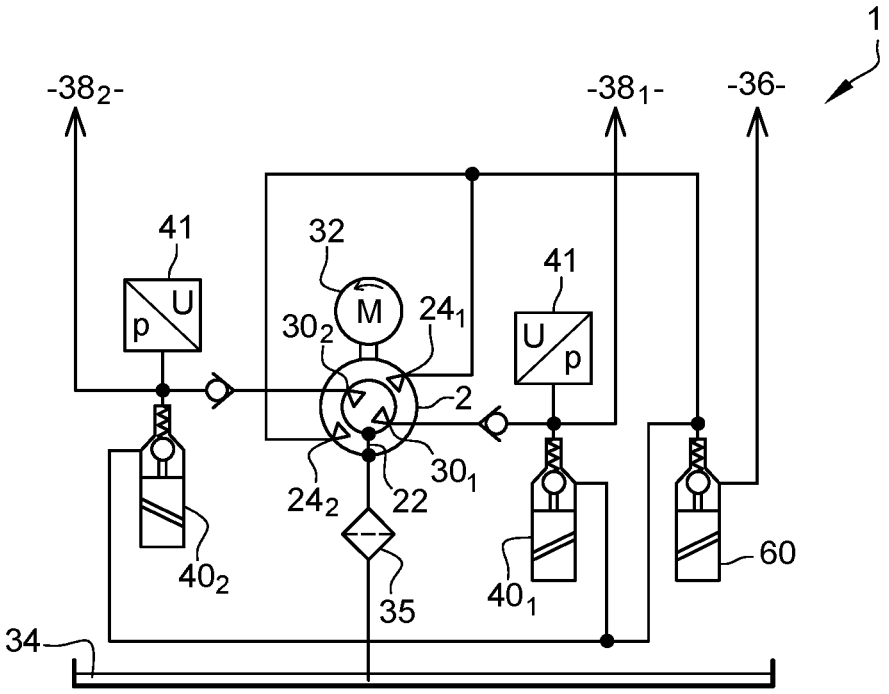
FIG. 13 schematically shows a pump unit according to an eighth embodiment of the invention.

FIG. 13 shows an eighth embodiment. The same reference signs are used for the components known from the preceding embodiments, and, to this extent, attention is drawn to the above explanations.

The eighth embodiment is based on the fourth embodiment but, in the same way as the pump unit 1 in FIG. 12, uses an accumulation valve 60. Said accumulation valve can accumulate the volume flow from the two low-pressure outlets $\mathbf{24}_1$, $\mathbf{24}_2$ of the hydraulic pump 2. Said volume flow is then applied to the two pressure-regulating valves $\mathbf{40}_1$, $\mathbf{40}_2$, with the result that, according to requirement, the actuators connected to the high-pressure outlets $\mathbf{38}_1$, $\mathbf{38}_2$ can be pre-filled quickly.

The invention claimed is:

1. A pump unit comprising:

at least one high-pressure port;

at least one low-pressure port;

a motor; and a hydraulic pump which has at least one high-pressure outlet and at least one low-pressure outlet, wherein the high-pressure outlet is connected to the high-pressure port via at least one pressure-regulating valve, wherein the hydraulic pump is a rotary vane pump having multiple rotary vanes which, together with a stator and a rotor, delimit multiple low-pressure chambers, wherein each rotary vane delimits a high-pressure chamber within the rotor, and wherein in at least one side wall of the stator, a high-pressure inlet is assigned exclusively to the high-pressure chamber, and a low-pressure inlet separate from the high-pressure inlet is assigned exclusively to the low-pressure chamber.

2. The pump unit according to claim 1, further comprising an integrated storage vessel from which drawing-in by the hydraulic pump is realized.

3. The pump unit according to claim 1, wherein the hydraulic pump has a low-pressure pump, into which a high-pressure pump is integrated.

4. The pump unit according to claim 3, further comprising a branch from the low-pressure outlet, wherein said branch leads to the suction side of the high-pressure pump.

5. The pump unit according to claim 1, wherein the high-pressure inlet is provided with a supply via a branch from the low-pressure outlet.

* * * * *